US006478209B1

(12) United States Patent
Bruins et al.

(10) Patent No.: US 6,478,209 B1
(45) Date of Patent: Nov. 12, 2002

(54) FEEDING AND DRIVING ASSEMBLY FOR A COMBINATION STAPLE-CAP FASTENER

(75) Inventors: Roger C. Bruins, Jenison; Roger A. Vanden Berg, Jamestown, both of MI (US)

(73) Assignee: National Nail Corporation, Grand Rapids, MI (US)

( * ) Notice: Subject to any disclaimer, the term of this patent is extended or adjusted under 35 U.S.C. 154(b) by 0 days.

(21) Appl. No.: 09/567,421

(22) Filed: May 9, 2000

Related U.S. Application Data

(63) Continuation-in-part of application No. 09/507,761, filed on Feb. 18, 2000, now abandoned.

(51) Int. Cl.[7] ..... B25C 5/16
(52) U.S. Cl. ..... 227/16; 227/136
(58) Field of Search ..... 227/15, 16, 18, 227/114, 116, 119, 136, 138

(56) References Cited

U.S. PATENT DOCUMENTS

| | | | | | |
|---|---|---|---|---|---|
| 3,353,737 | A | | 11/1967 | Howard et al. | 227/136 |
| 3,727,821 | A | | 4/1973 | Pabich et al. | 227/120 |
| 3,854,648 | A | | 12/1974 | Inzoli et al. | 227/136 |
| 4,998,662 | A | * | 3/1991 | Hasan et al. | 227/111 |
| 5,042,142 | A | * | 8/1991 | Beach et al. | 227/111 |
| 5,069,340 | A | * | 12/1991 | Ernst et al. | 206/347 |
| 5,267,682 | A | * | 12/1993 | Okouchi | 227/120 |
| 5,292,048 | A | | 3/1994 | Vanderwiel | 227/21 |
| 5,484,094 | A | * | 1/1996 | Gupta | 227/113 |
| 5,605,269 | A | * | 2/1997 | Musiani | 227/109 |
| 5,634,583 | A | | 6/1997 | McGuinness et al. | 227/120 |
| 5,653,372 | A | * | 8/1997 | Richardson et al. | 227/110 |
| 5,695,108 | A | * | 12/1997 | Lee | 227/109 |
| 5,947,362 | A | | 9/1999 | Omli | 227/120 |

FOREIGN PATENT DOCUMENTS

| | | |
|---|---|---|
| WO | WO 99/39878 | 8/1999 |

* cited by examiner

*Primary Examiner*—Scott A. Smith
*Assistant Examiner*—Nathaniel Chukwurah
(74) *Attorney, Agent, or Firm*—Flynn, Thiel, Boutell & Tanis, P.C.

(57) ABSTRACT

A fastener applying device for causing a driven staple to be driven through a disk-like cap to create a staple-cap fastener for securely attaching flexible or deformable materials to a substrate. The device includes an automatic stapler capable of automatically driving a staple into the substrate. The device also has a cap feeding device including a magazine containing a reel of caps positioned generally edge-to-edge and joined in a continuous strip, such as by an adhesive tape. The cap strip is fed from the reel into a guide track which feeds the leading cap of the strip into a driving region disposed below the discharge end of the staple driver. The guide track defines thereon stops which straddle the driving region, and which positionally contact the structure into which the fastener is to be driven.

23 Claims, 7 Drawing Sheets

FEEDING AND DRIVING ASSEMBLY FOR A COMBINATION STAPLE-CAP FASTENER

CROSS REFERENCE TO RELATED APPLICATION

This is a continuation-in-part of our application Ser. No. 09/507,761, filed Feb. 18, 2000, now abandoned entitled "FEEDING AND DRIVING ASSEMBLY FOR A COMBINATION STAPLE-CAP FASTENER".

FIELD OF THE INVENTION

This invention relates to a fastener applying device particularly for use in the construction industry, and more specifically to an improved device capable of feeding a cap into a position for penetration by a staple to improve the capability of using staples in use situations previously not considered satisfactory, such as for securing roofing underlayments, and to a fastener applying device having an improved track and feed mechanism for feeding caps to a position for engagement with a fastener such as a staple.

BACKGROUND OF THE INVENTION

Fastener applying or driving devices known as automatic nailers or staplers are extensively used in the construction industry, although their use for attaching roofing materials to a roof substrate has been severely limited due to the thinness, strength and flexibility characteristics associated with most roofing materials. While automatic staplers and nailers have been used to secure roofing shingles inasmuch as the fastener (i.e. the nail or staple) is ultimately covered by a superimposed shingle, nevertheless these automatic fastening devices have not found wide acceptance or utilization for securing roof underlayments such as tar paper or foam insulating board to the roof substrate due to the thin and/or flexible characteristics of these materials. While automated staplers have in some geographic areas been utilized to secure the tar paper to the roof substrate, this securement provides only a weak attachment, and as such it is imperative that the roofing shingles be immediately applied over the underlayment so as to prevent undesired damage thereto. More conventionally, such underlayments have been secured to the substrate using nails having plastic caps mounted under the head, which nail and cap provides a significantly enlarged gripping area between the cap and substrate so as to permit more secure attachment of the underlayment to the roof substrate. These cap-type nails, however, have traditionally required that they be manually applied, and such is still a very common practice.

Further, when automatic staplers are used for securing either roofing shingles or underlayments to the roofing substrate, the staplers used in the roofing industry traditionally utilize a large staple having about a one inch crown (i.e. width) since such large staple is believed necessary in order to attempt to provide a reasonable securement of the staple over the shingle or underlayment. Staplers using small-size staples are thus not practical for use in roofing applications.

Further, the securement of roofing shingles to the substrate by use of staples is, in most areas within the United States, no longer acceptable since staples have not proven to provide the requisite holding force. Further, staples are also normally not acceptable for securing the underlayment, such as roof felt or vapor wrap (i.e., Tyvap), since the very small holding power of staples readily permits the underlayment to tear through the staple, and hence staples can normally be used only in those situations where the underlayment will be immediately covered by another exterior layer such as roofing shingles.

Other prior attempts to secure underlayment to roofing substrate has, many years ago, involved the use of thin round metal disks (typically called "tin tabs"), which tin tabs were typically between about 1⅝ and 2 inch diameter and were manually applied. Initially these tin tabs were individually secured by a plurality of staples, but securing the tin tabs by staples was not commercially acceptable, and most building codes where tin tabs are acceptable now require that the tin tabs be secured using nails. Further, tin tabs continue to be utilized only in a very small number of geographic areas, specifically a few counties in Florida.

In an effort to provide for increased efficiency of securing the underlayment to the roof substrate, the Assignee hereof has developed a fastener applying device which incorporates therein a nailer capable of individually supplying nails from a magazine and individually driving-the nails into the roof so as to permit more efficient and less strenuous securement of the underlayment to the roof substrate. This improved device in addition mounts a basket containing a plurality of plastic caps which are flexibly joined together in side-by-side relationship so as to define a continuous elongate strip which is formed into a spirally-wound reel. The strip of caps withdrawn from the reel is intermittently advanced so as to sequentially supply a cap into the driving zone for penetration by a nail during each driving cycle of the device. Standard nails as disposed within the nail magazine can thus be utilized and the individual nails penetrate respective caps during the nailing operation so as to permit more automated and efficient securement of the underlayments to the roof substrate while at the same time resulting in a cap-type nail being used as the fastener. The improved fastening device described above is illustrated in International Publication WO 99/39878, owned by the Assignee hereof, and the disclosure of this latter publication is incorporated herein by reference. The improved device of this latter publication is also manufactured and sold under license.

While the device capable of feeding and integrating caps and nails, as described above, represents a highly desirable advancement in the construction industry, particularly for securing underlayments to roof substrates, nevertheless there is an ongoing desire to improve the construction and operational simplicity of the device, and to reduce costs associated therewith. For example, the aforementioned device utilizes a loop-like foot structure which closely surrounds and effectively confines the leading cap when in the fastener driving position, and this foot structure is slidably supported on the tool head for significant vertical movement and interconnected with the safety device which must be depressed prior to activation of the device by the manual trigger. This foot arrangement increases the overall complexity of this structure, and of the cap dispensing, and is also a relatively costly structure to manufacture and assemble. The cap feeding arrangement of this device also utilizes a feeding mechanism which engages the caps spaced away from the fastener driving position and, while this device for the most part operates in a satisfactory manner, nevertheless there is concern that this positional relationship may increase the tendency for the advanced caps to buckle or move out of proper position.

Another recognition of the desire to provide an automatic nailer capable of also feeding caps for use in conjunction with the nails is illustrated by U.S. Pat. No. 5,947,362. However, to the best of Applicant's knowledge, the arrangement illustrated by this latter patent has not been successfully built and operated, either experimentally or commercially.

Accordingly, it is an object of this invention to provide an improved fastener-applying device which is capable of feeding both staples and caps so as to permit individual staples to be driven through respective individual caps so as to permit staples to be used for securement in situations previously not considered feasible, such as for securing thin and/or flexible underlayments to a roofing substrate.

It is also an object of this invention to provide an improved fastener applying device, as aforesaid, which incorporates improved structural and operational simplicity with respect to the track arrangement which feeds caps to the fastener driving region, particularly with respect to the driving and guiding and hold-down structures for the caps, to facilitate the moving of a leading cap into the driving region and the subsequent driving of a fastener therethrough for attachment to a structure such as a roof substrate.

It is a further object of the invention to provide a new and improved fastener applying device, as aforesaid, wherein the device enables the use of significantly smaller staples than conventionally previously felt feasible for use in the roofing industry, and which staples when used in conjunction with the caps provide a significantly increased holding capability with respect to the securement of underlayments to the roofing substrate while permitting such attachment to be carried out in a more automated and time-saving manner and with a higher degree of uniformity.

According to the present invention, there is provided a cap-fastener feeder driver assembly which includes an automatic stapler combined with an automatic cap feeding arrangement so that a disk-like cap is positioned below the staple driver and, upon actuation of the latter, the discharged staple penetrates the cap and fixedly secures the cap-staple combination to the designated wall, such as a roof substrate, to attach other overlayments thereto. The automatic stapler is, by itself, substantially conventional in that it includes a driving head having a transversely projecting handle, and an elongate staple-holding cartridge is secured to and projects transversely from the lower end of the driving head to permit sequential feeding of staples into the guide tube for the reciprocating staple driving member. The cap feeding assembly includes a magazine or basket which contains therein a spirally wound reel of caps which are positioned and joined together in substantially edge-to-edge relationship, with the caps in the preferred embodiment being joined in a continuous strip by an elongate length of adhesive tape. The caps from the reel contained in the magazine are discharged therefrom into a guide track which projects transversely toward and is fixedly supported from the driving head. The guide track has its free or discharge end disposed longitudinally spaced a selected distance from the free end of the driving tool, with the track defining an open region aligned with the tool to accommodate a cap in a driving position for engagement and penetration by a driven staple. The track has appropriate guiding and hold-down structures associated therewith for controlling the positioning of the strip of washers therein, and also has an advancing device movably associated therewith for engaging and forwardly advancing the endmost washer of the strip into the driving position prior to activation of the stapler.

The feeder driver assembly of the invention incorporates preferred features wherein the track, at least adjacent the end thereof where it feeds into the driving region, preferably extends at a substantial angle relative to the feeding direction of the staples in the staple cartridge, which angle is preferably about 45°, whereby the staple is angularly oriented so as to extend at least partially in the lengthwise direction of the tape which joins the caps together, thereby maximizing the width (i.e. bridge) of the staple while still enabling both legs of the staple to normally effectively penetrate the tape when the staple is driven through the cap. With this arrangement, the leading cap is advanced into the driving zone disposed adjacent the end of the track so as to be aligned with and spaced from the free end of the guide tube for the staple driver. A stop part is provided at the end of the track which, in the preferred embodiment, comprises a pair of sidewardly spaced and substantially parallel legs which straddle the cap located in the driving zone, and which are adapted to define a position of contact engagement with the wall structure to which attachment of the staple is desired. Activation of the trigger on the drive head causes the internal motor to be activated which rapidly extends the staple driving tool and projects the staple outwardly and causes it to penetrate the washer, and the tape thereon, and thereafter penetrate the wall structure so as to fix the staple-cap thereto. The penetration of the tape by the legs of the staple creates two locations which are typically disposed adjacent opposite sides of the tape so as to create weakened zones between the penetrating holes and the tape edges. Initial tearing of the tape may occur due to the slight downward displacement thereof during driving of the staple therethrough. However, when the operator moves the assembly away from the wall structure, the weakened tape sections adjacent the holes formed by the staple legs will tear, if they had not already done so, and the staple will also function as a cutting edge to effect tearing therealong so as to create a tear between the two staple leg holes, thereby effecting severing of the tape on the secured washer from the tape which extends back to the leading washer located in the guide track. When the air motor of the drive head retracts the staple driver, then a driving device cooperates with the lead washer in the guide track and advances same into the driving region defined below the staple driving member.

The present invention also relates to a cap-fastener feeder driver assembly wherein the guide track for feeding a strip of interconnected caps toward a driving zone disposed adjacent a fastener driving element includes a reciprocating feeding device which includes a driving part which preferably engages the leading cap in the strip so as to positively directly push on this cap so as to advance same into the region aligned with the driving tool, with the feeder also preferably directly drivingly engaging the next adjacent cap so as to simultaneously positively drive same forward into the lead position for the next cycle of operation. The guide track arrangement also preferably incorporates a simplified hold-down structure which cooperates directly with the lead cap so as to maintain same in proper position and prevent accidental or undesired upward or rearward movement thereof. This hold-down structure, in combination with the feeding device, and their joint cooperation with the lead cap, ensures accurate and proper feeding of the lead cap so as to minimize misfeeds, misalignment or other undesired and disruptive movements or positions of the caps, and counteracts the return force of the cap feeder.

The present invention has also provided a surprising and unexpected result in that securing a roof underlayment with a plastic cap by means of a staple has proven to provide a significantly greater lateral holding force than would otherwise be expected. In the conventional practice of securing a roof underlayment by means of a plastic cap secured by a nail, a significant lateral holding force is created where the plastic cap, due to its deformation and securement with the nail, engages the underlayment. Applicants have discovered, however, that the present invention utilizing a staple for securing the deformable plastic cap to the underlayment has provided surprisingly good lateral holding force which, while less than that obtained by a nail, is nevertheless far superior to what was expected. This desirable lateral holding force as created by the present invention, however, appears to be optimized when the staple has a crown width in the range of about 35% to about 50% of the cap diameter, so that for a typical one inch diameter plastic cap, a staple crown width of ⅜ to ½ inch is believed to provide the best results. While the exact reason for this is not fully understood, nevertheless it is believed that these relationships may provide for more effective compression of the domed portion of the plastic cap, similar to deflection of a spring, so as to optimize the clamping engagement between the cap and the roof underlayment.

Other objects and purposes of the present invention will be apparent to persons familiar with the noted industrial area upon reading the following specification and inspecting the accompanying drawings.

Figure 1:
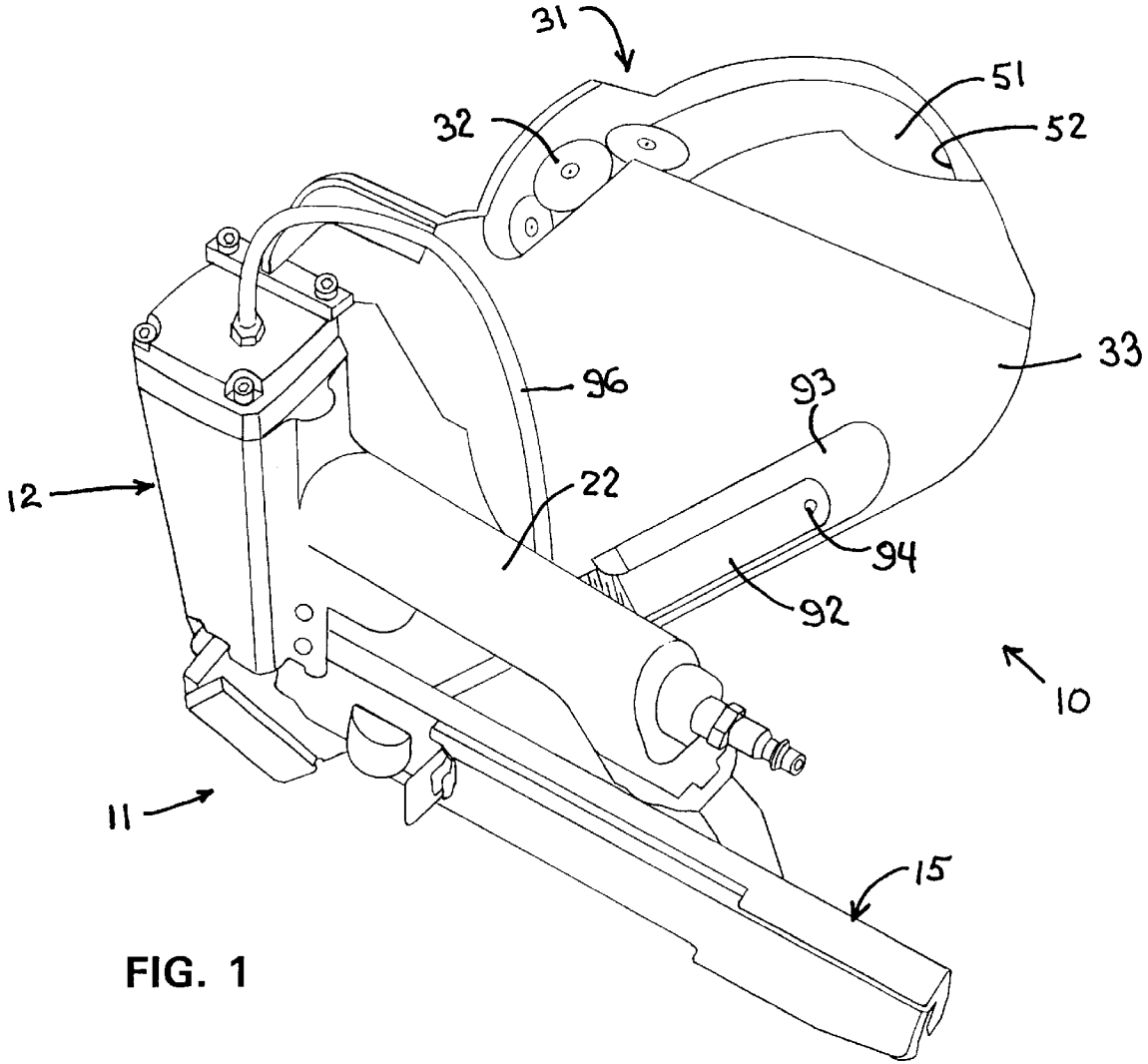
FIG. 1 is a perspective view of a feeder driver assembly for a cap-fastener according to the present invention.

Certain terminology will be used in the following description for convenience in reference only, and will not be limiting. For example, the words "upwardly", "downwardly", "rightwardly" and "leftwardly" will refer to directions in the drawings to which reference is made. The words "endwardly" and "outwardly" will refer to directions toward and away from, respectively, the geometric center of the assembly and designated parts thereof. The terminology will include the words specifically mentioned, derivatives thereof, and words of similar import.

DETAILED DESCRIPTION

Referring to the drawings and specifically FIGS. 1–4, there is illustrated a feeder driver assembly 10 according to the present invention. This assembly includes a generally conventional automatic stapler 11 which includes a driving head or housing 12 which defines therein a conventional double-acting air motor, the moving piston of which is connected to and effects driving of a staple driving element 14 which projects. downwardly from the lower end of the drive head and is slidably guided within a tubular guide 13 which is fixed to and projects downwardly from the drive head. The driving element 14 effects discharge and driving of a staple generally along an axis 20.

The drive head 12 mounts thereon, adjacent the lower end thereof, an elongate staple cartridge 15 which extends transversely in approximately perpendicular and intersecting relationship to the driving axis 20. This staple cartridge 15 is defined by a housing having a support rail 17 extending lengthwise thereof for supporting thereon, in a conventional manner, a row of channel-shaped staples 18, which staples when supported on the support rail are disposed so as to open downwardly. The staples 18 are fed lengthwise of the cartridge along a feed direction or axis 19 which approximately perpendicularly intersects the driving axis 20. The staple cartridge has a spring-urged pusher 21 slidably supported on the support rail and urged into pushing engagement with the rear or outer end of the row of staples 18 so as to continuously urge the staples into a position wherein the leading staple will be engaged and driven vertically downwardly of guide tube 13 by the staple driver 14.

The automatic stapler 11 also has a handle 22 which projects transversely from the drive housing 16 adjacent the upper end thereof, which handle 22 in the illustrated embodiment has a fitting 23 at the other end for attachment to a conventional conduit or hose for supplying pressurized fluid, specifically air, to the double-acting driving motor disposed within the drive head 12. A brace 24 has one end fixed adjacent the outer end of the handle, and the brace 24 projects downwardly for attachment to the staple cartridge 15 adjacent the outer end thereof. The other end of the staple cartridge is suitably attached to the lower end of the drive head in a conventional manner.

The drive head 12 has a movable trigger 25 positioned thereon directly under the handle for controlling supply of air to the upper chamber of the internal air motor to effect downward driving of the staple driving element 14. In the illustrated embodiment the drive head also has a movable safety element 26 which is disposed adjacent and is vertically movably supported adjacent the tubular guide 13. This safety element has a height-adjustable foot part 27 provided on the lower end thereof in position for engagement with a structure into which a staple is to be driven, and the upper end of safety element 26 projects upwardly into the drive housing 14 for cooperation with a control valve (not shown) therein. The foot part 27 projects downwardly a predetermined distance below the lower free end of the tubular guide 13 so as to define a driving zone or region 28 below the guide 13. The movable safety element 26 is moved upwardly when the stapler is moved into engagement with a wall structure and this upward movement of the safety element 26, in conjunction with activation of the trigger 25 by the operator, enables air to be supplied to the upper chamber of the air motor so as to permit a staple discharge operation to occur. If the safety element 26 is not depressed, however, then activation of the trigger will not effect discharge of a staple.

The overall construction and operation of the automatic stapler 11, as described above, is substantially conventional and well-known. One example of such stapler is manufactured by Senco, so that further discussion as to the constructional and operational details of the stapler is believed unnecessary. Other known staplers utilize constructional and operational features which are somewhat different, but still result in the same basic mode of operation, and as such are suitable for use with the overall feeder driver assembly of the present invention.

The cap-fastener feeder driver assembly 10 also includes a cap feeder assembly 31 for feeding thin disk-like caps 32 to the driving zone 28. The caps are supplied from a magazine or basket 33 which contains therein a spirally wound spool or reel of caps which are connected together in substantially edge-to-edge relationship, with the caps being withdrawn from the magazine 33 and fed in an intermittent and sequential manner through a guide track 35 for discharge into the driving zone 28, as explained in greater detail hereinafter.

Figure 12:
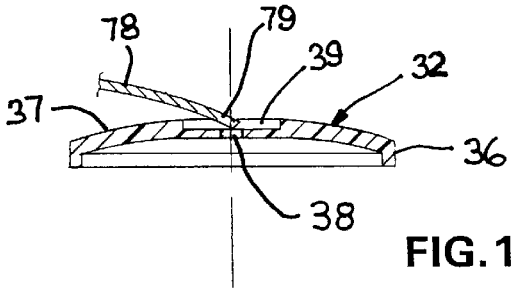
FIG. 12 is an enlarged fragmentary sectional view showing the cooperation between the resilient hold down and the cap in the lead position.
Figure 13:
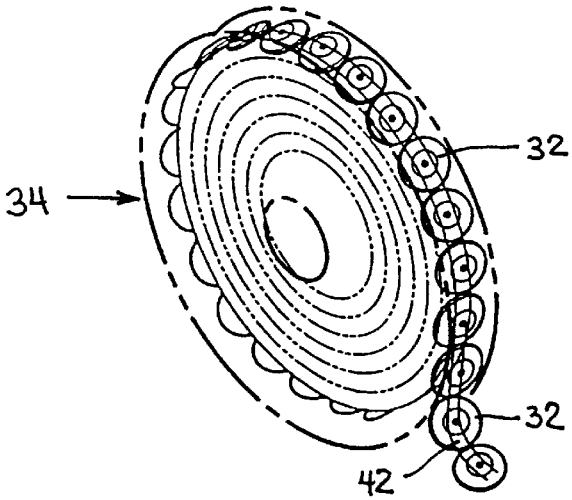
FIG. 13 diagrammatically illustrates a cap reel.

The caps 32 (FIG. 12) are preferably thin disk-like elements having a circular shape defined by a circular peripheral edge 36, with the cap having an upper surface 37 which is of a rounded convex curvature resembling a truncated cone, with the cap having a through opening 38 extending therethrough substantially along the central axis of the cap. The upper surface of the cap also has a shallow downward annular depression or recess 39 formed therein in surrounding relationship to the center hole 38, which recess 39 has a diameter which is substantially smaller than the overall diameter of the cap and which projects downwardly through only a small fraction of the thickness of the cap. The bottom surface of the cap is typically of a rounded concave curvature so that the cap has a dome-like configuration which projects up from the annular peripheral edge thereof. The caps are typically constructed of a plastic material and can be resiliently downwardly deformed, and typically have a diameter of about one inch.

The caps 32 are disposed in closely adjacent but slightly spaced side-by-side but spaced relationship so that the edges of adjacent caps are thus disposed adjacent but with a slight spacing therebetween, which spacing is in the preferred embodiment about 0.050 inch. The caps are connected together in this side-by-side but spaced relationship so as to define an elongate strip of caps 41 with the joining of the caps in the preferred embodiment being accomplished by means of a thin flexible strip of adhesive tape 42 which extends along the series of caps and is adhesively joined to the upper surfaces thereof. The elongate strip of adhesive tape 42 is disposed with its longitudinally extending center axis disposed so as to preferably pass substantially through the central axis of the caps, whereby the adhesive tape 42 is thus positioned so as to pass diametrically across the central portion of the caps. The tape 42 preferably has a width 43 which is substantially less than the diameter of the caps, with the width 43 preferably being approximately no more than one half the cap diameter, for example one-half inch. In the illustrated and preferred embodiment, the tape has a width of about ⅜ inch.

Further structural and functional details of the caps, the tape and the connection therebetween are described in detail in aforementioned WO 99/39878, incorporated herein by reference, so that further description thereof is believed unnecessary.

The cap magazine 33 comprises a housing having a chamber or hollow interior 51 which defines an upper opening 52 so as to permit a spool or reel of caps to be positioned therein, which caps when spooled are disposed so that the convex outer surfaces of the caps and the adhesive strip of tape connecting same is thus disposed radially outermost relative to the center axis of the spool. The spool is disposed within the chamber 51 of housing 33 so that the spool, during unwinding of the caps, rotates clockwise in FIG. 4, with the outermost free end of the cap reel being fed downwardly of the housing for discharge through the discharge passage 54 defined by the curved discharge part 53 of the housing.

The housing or magazine 33 is fixedly connected to one end of an elongate guide track 35, which guide track is aligned with the discharge passage 54 and fixed to the curved discharge part 53. The other end of the guide track has a pair of support arms 55 and 56 which are fixed to opposite sides thereof and which project upwardly in straddling relationship to the drive head for securement thereto, such as by means of fasteners such as screws or the like. A further support bracket 57 is fixedly connected between the upper end of the drive head 13 and a front upper portion of the magazine 33.

Figure 2:
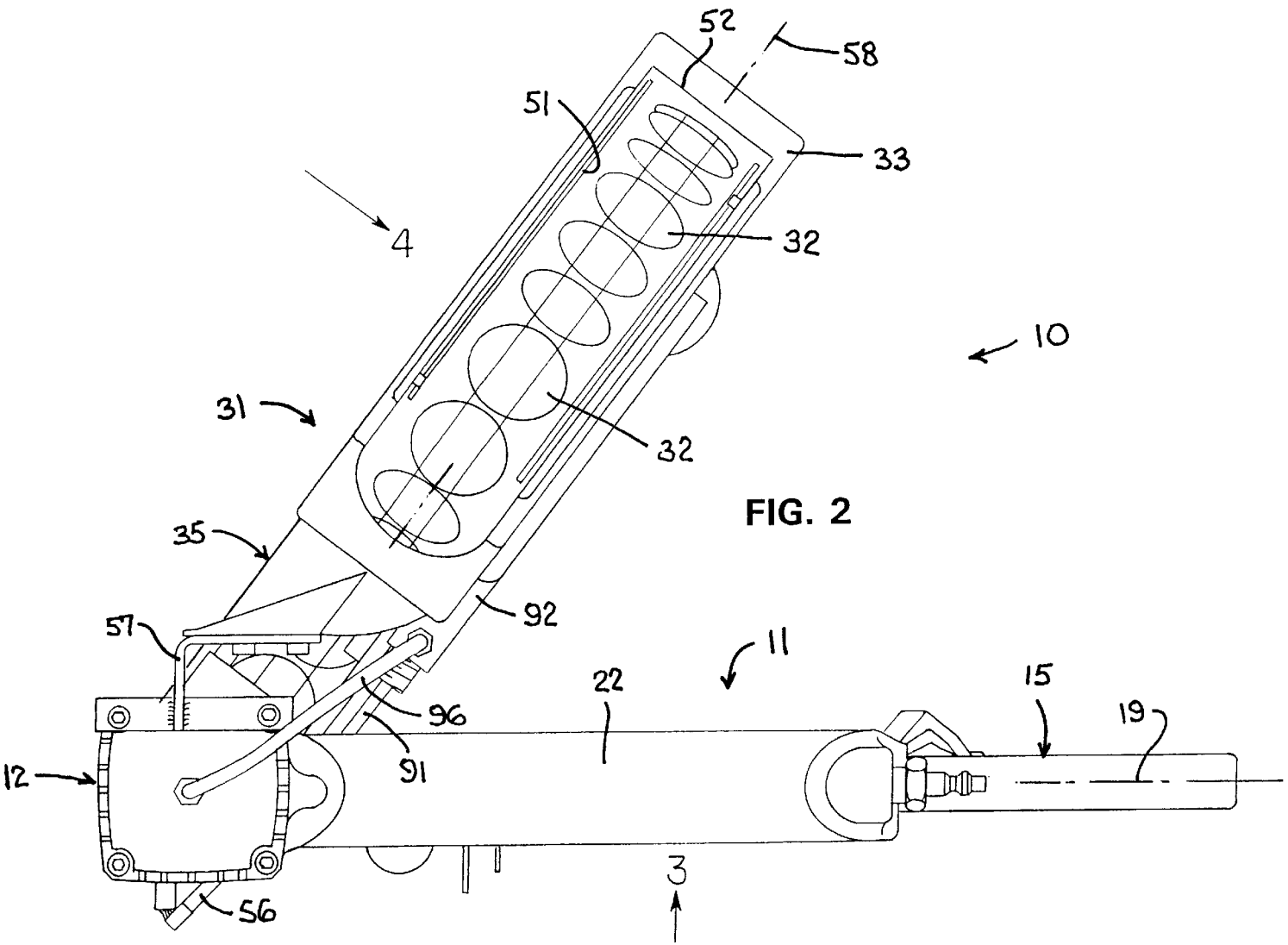
FIG. 2 is a schematic top view of the assembly shown in FIG. 1.
Figure 3:
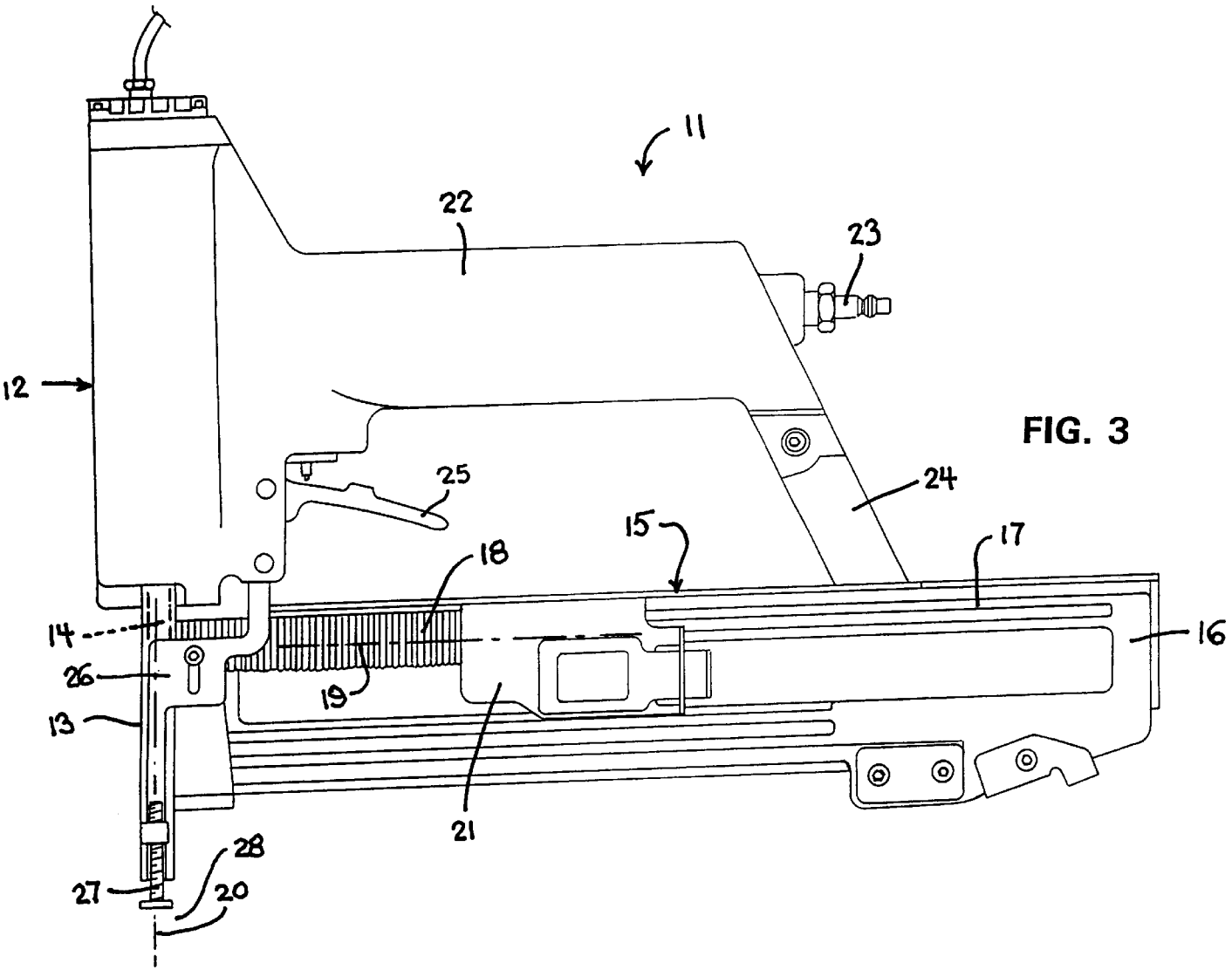
FIG. 3 is a side elevational view taken in the direction of arrow "3" in FIG. 2 and showing principally the automatic stapler, the cap feeding structure being eliminated for simplicity of illustration.
Figure 4:
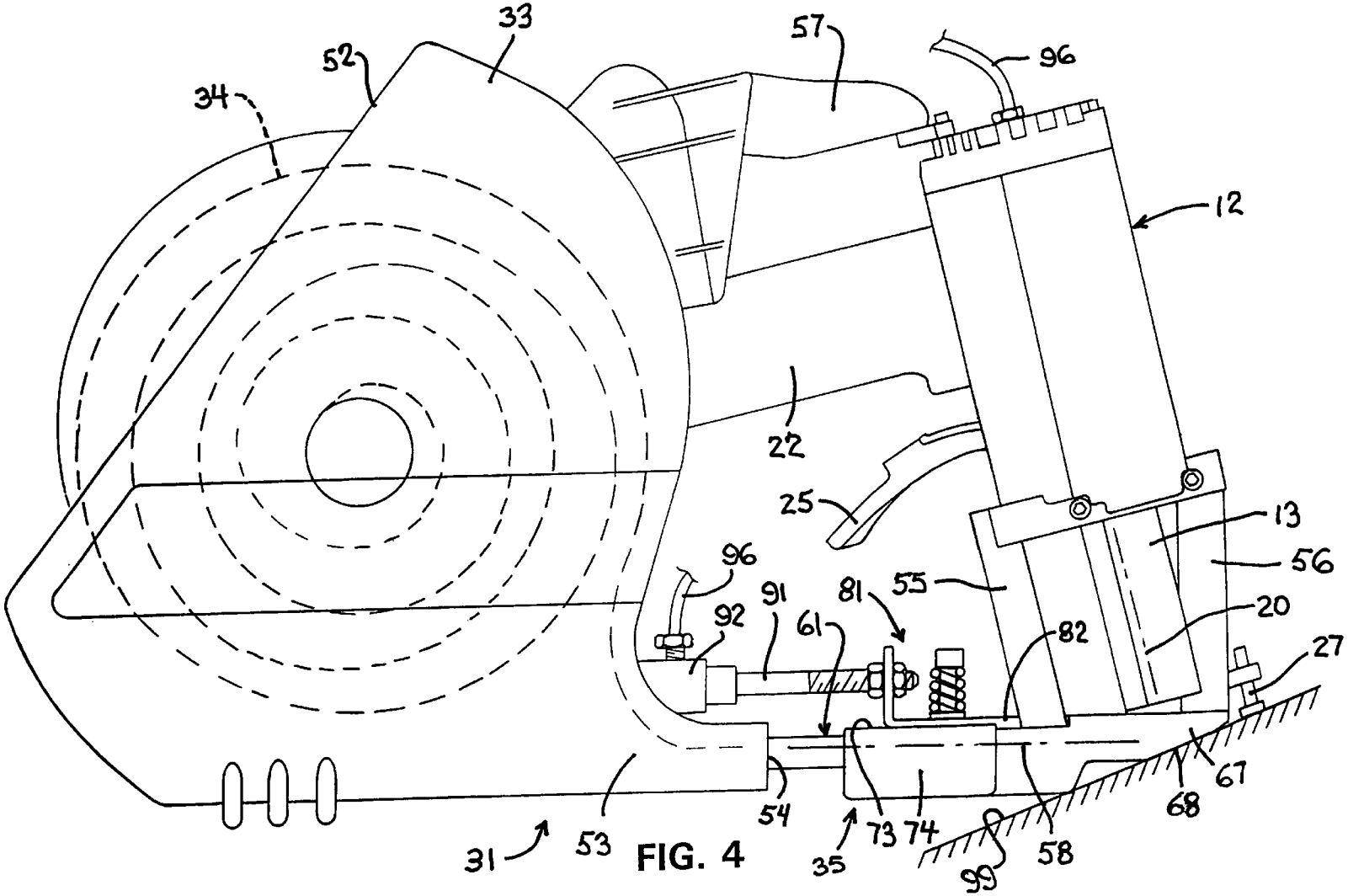
FIG. 4 is a side elevational view taken generally in the direction of arrow "4" in FIG. 2 and showing principally the cap feeder assembly and its connection to the stapler, the details of the staple cartridge being deleted for clarity of illustration.

In the preferred embodiment as illustrated by FIGS. 2 and 4, the elongate direction of the guide track 35 and the positioning of the magazine 33 generally as an extension of the guide track, define a feed direction or axis 58 for the caps which, when viewed in a plane which is substantially perpendicular to the driving axis 20, such as viewed in FIG. 2, extends at an angle of about 45 degrees relative to the staple feeding axis 19.

Considering the guide track 35 and referencing FIGS. 5–10, the guide track includes an elongate track member 61 which extends from the discharge of the cap magazine 31 to a position disposed below the discharge end of the driving head 12. The track member 61 has a shallow upwardly-opening channel shaped cross-section defined by a base wall 62 which slidably supports thereon a strip of caps as discharged from the magazine. The base wall has generally parallel side flanges 63 and 64 projecting upwardly from opposite sides thereof so as to define a shallow guide channel 65 in which the strip of caps is slidably guided and supported.

The base wall 62 of the track member, at the outer ends thereof, is provided with an arcuate concave front edge 66 which resembles a semicircle so as to facilitate the discharge of caps. The side flanges 63 and 64 of the track member 61, at the outer end, project outwardly beyond the front edge of the base wall 62 and terminate in cantilevered nose parts 67 which are spaced apart by a width which closely conforms with but typically slightly exceeds the diameter of the cap, with these nose parts being positioned under the driving head 12 generally at the elevation of the driving zone or region 28 but disposed on opposite sides thereof so that the driving axis 20 substantially centrally intersects the space between these nose parts 67, with the axis 20 also being spaced forwardly from the arcuate edge 66 by a distance which preferably at least slightly exceeds the radius of the cap.

The nose parts 67 are provided with bottom surfaces 68 which are disposed in close proximity to the free ends of the nose parts, but which angle or slope downwardly as they project rearwardly away from the free ends. These tapered bottom surfaces 68 on the nose parts 67 permit the nose parts to effectively function as stops by permitting the tapered bottom surfaces 68 to be disposed in contact with a surface of a wall structure 99, and positioned flush or coplanar therewith, thereby defining the proper attaching position in which the driving head 12 extends approximately perpendicular to the wall surface while at the same time the cap feeder and the track angle or slope upwardly away from the wall surface so as to prevent interference therewith. The disposition of the bottom tapered surfaces 68 of the nose parts 67 is such that these surfaces 68 are normally spaced upwardly from the lowermost position of the safety foot 27 so that the latter is forced to slide upwardly upon contact with the wall surface in order for the nose parts 67 to be moved into contact with the wall surface, substantially as illustrated by FIG. 4.

To assist in controlled slidable displacement of the cap strip along the track member 62, the latter has a top guide plate 63 fixed thereto and disposed so as to project in generally parallel relationship with and vertically spaced relationship above the base wall 62. The spacing between base wall 62 and top guide plate 73 is such as to allow the cap strip to freely slidably pass through the tunnel-like region created by this structure. The top guide plate 73, in the illustrated embodiment, has a downwardly turned flange 74 at one side which overlaps one of the side walls of the track member for fixed securement thereto by conventional fasteners 75, such as screws.

The guide track 35 also has a top hold-down member 76 which cooperates with the leading cap (designated 32A) of the cap strip within the guide track, namely the cap which is positioned on the base wall 62 at the discharge thereof, namely directly adjacent or partially overlapping the arcuate end edge 66, which lead cap 32A is thus disposed in a position so as to be fed or discharged into the driving zone 28. The top hold-down member 76, in the illustrated embodiment, is an elongate member which is disposed above the cap strip and extends generally longitudinally thereof, with the rear portion of this member being fixedly mounted on the top guide plate 73, such as by means of screws 77. The top hold-down member 76 has a front part 78 which is cantilevered forwardly generally along the center longitudinally extending direction of the trackway so as to be disposed directly above the cap strip, with this front part 78 having a front free end portion 79 which is deflected downwardly so as to project into the shallow central recess 39 defined in the top of the cap disposed at the lead or feed-in position, namely the cap 32A. The front part 78 is defined generally as an elongate cantilevered spring which is normally deflected downwardly so as to cause the free or tip end to engage in the top recess of the cap at the lead position, thereby preventing undesired displacement of the cap either forwardly or rearwardly, while at the same time this front part 78 can deflect upwardly so as to allow the cap to be drivingly displaced forwardly into the driving position 28, with the resilient front part 78 being resiliently deflectable so as to engage into the shallow top recess associated with the next trailing cap as the latter moves into the lead position.

The guide track 35 also has a cap feeding or advancing mechanism 81 associated therewith so as to permit intermittent advancing movement through a distance which approximately equals a single cap size, thereby permitting the lead cap 32A to be advanced from the track member into the driving region 28. This cap advancing mechanism 81 includes a feeder or picker member 82 which is formed generally as a flat plate which is slidably supported on a side top flange 83 which is fixedly secured to the side flange 64 of the track member 61. The advancing member 81 has an elongate guide slot 85 formed therein and extending lengthwise thereof in parallel relationship to the elongate direction of the track member. A guide pin 84 is fixed to the track member and projects vertically upwardly through the slot 85, thereby slidably guiding the advancing member for reciprocating movement generally parallel with the longitudinal axis of the track member. This guide pin 84 also has a spring 86 associated therewith which acts downwardly against the advancing member so as to hold it in sliding engagement with the stationary top flange 83.

To cooperate with and forwardly intermittently advance the cap strip, the advancing member 81 has respective front and rear cap driving projections 87 and 88 which project vertically downwardly from the advancing member so as to project downwardly into the guide channel. These drive projections 87 and 88 are spaced sidewardly between the longitudinal center of the guide channel and the side flange 64 so that the drive projections project downwardly into the triangular-shaped clearance spaces defined between two adjacent caps, with the projections also being spaced sidewardly so as to not interfere or penetrate the connecting tape.

Figure 6:
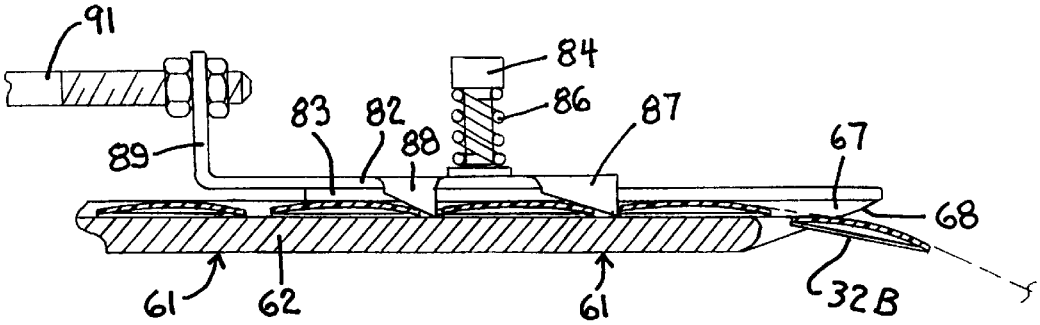
FIG. 6 is an enlarged fragmentary sectional view showing the feeder for the cap strip in its retracted position.

The front drive projection 87, when the cap advancer is in the rear or retracted position illustrated by FIG. 6, projects into the triangular clearance space disposed on the upstream side of the lead cap 32A, and the trailing projection 88 projects into the clearance space disposed upstream of the next adjacent upstream cap. Forward movement of the advancing member 82 thus results in the front drive projection 87 directly engaging and driving the lead cap forwardly into the driving zone 28, and simultaneously the rear projection 88 engages the rear of the next cap and effects forward positive driving thereof into the lead position. The simultaneous driving of these two caps at the same time pulls the remainder of the cap strip forwardly along the track and withdraws same from the magazine. The fact that the front driving projection always cooperates directly with and effects forward driving of the lead cap into the driving region 28 thus optimizes the control and hence the movement of the lead cap so as to prevent or minimize undesired malfunctioning of the device.

The advancing member 82 at its rear edge has an upturned flange 89 which is joined to the free end of a piston rod 91, the latter projecting outwardly from a fluid pressure cylinder 92, preferably an air cylinder. The air cylinder 92 is disposed directly adjacent one side of the magazine housing and is connected thereto, and is partially enclosed within a shroud 93. The inner or rearward end of the housing of pressure cylinder 92 is connected to the magazine housing by a hinge 94 which permits the cylinder and the advancing member 82 to hinge or pivot upwardly against the urging of the spring 86 so as to permit retraction of the advancing member 82 from the forward position of FIG. 7 to the rearward position of FIG. 6. The drive projections 87–88 have sloped rear surfaces thereon to facilitate their being able to cam upwardly over the caps during the return movement, with the front surfaces of the driving projections being substantially straight or vertical so as to more effectively abut and thus effect forward displacement of the caps during forward driving movement.

The fluid pressure cylinder 92 preferably is driven by air pressure only during the retracting movement, such typically being supplied from the main drive head 12 via the hose 96, with the pressure cylinder having an internal spring (not shown) which normally effects forward displacement of the piston rod from the retracted to the forward position when the air pressure to the cylinder is relieved.

The overall operation of the staple-cap feeder driver device 10 will now be briefly summarized.

Figure 5:
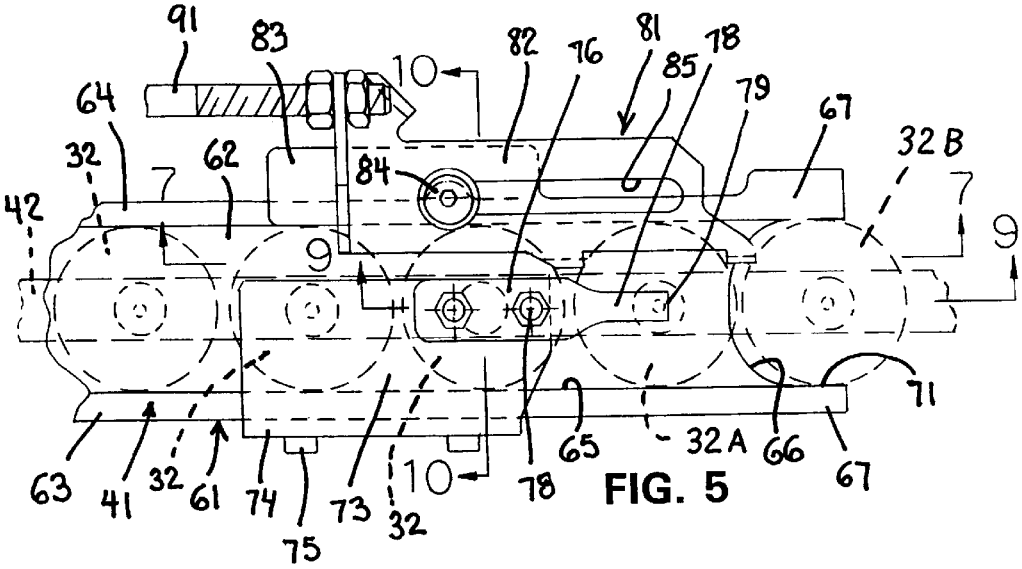
FIG. 5 is an enlarged fragmentary view showing the guide track for the cap strip as it extends from the cap magazine to the driving zone, which view is taken generally along the line 5—5 in FIG. 4.
Figure 7:
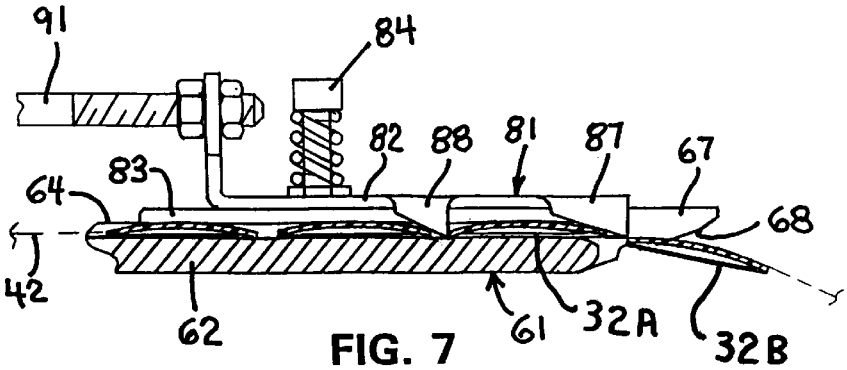
FIG. 7 is an enlarged fragmentary sectional view taken generally along line VII—VII, in FIG. 5 and showing the feeder for the cap strip in its advanced position.

The cap reel 34, wherein the elongate strip of caps is spirally wound so that the convex curvature of the caps 32 and the adhesive tape strip 41 secured thereto is disposed radially outermost, is positioned in the magazine 33 such that the outer free end of the cap strip 42 is fed in a clockwise direction in FIG. 4 within the magazine and is fed downwardly along the front wall of the magazine and thence around and into the curved discharge part 53 for feeding through the discharge passage 54. From the passage 54 the leading end of the cap strip is fed along the guide track 35 and advanced until the endmost cap 32B of the cap strip is positioned in the driving zone 28 and is maintained in a generally suspended position in this zone, as illustrated by FIG. 7, due to its attachment to the lead cap by means of the adhesive tape connected therebetween. In this position, the cap advancing mechanism 81 and its associated drive cylinder 92 is disposed in its advanced position as illustrated by FIGS. 5 and 7. Further, the lead cap 32A is engaged with the free end 79 (FIGS. 9 and 12) of the spring part 78 of the hold-down member 76 so as to hold the lead cap in position and prevent it from improperly moving either forwardly or rearwardly or upwardly, with this lead cap still being sidewardly confined between the side walls of the guide track. The device 10 is thus in a position for use.

To effect use and specifically driving of a staple-cap fastener into a structure, such as a roof substrate having an underlayment positioned thereover, such being diagrammatically illustrated at 99 in FIG. 4, the operator who is manually supporting the device 10 by means of the handle 22 positions the device such that the lead end of the guide track 35 contacts the structure 99, and specifically positions the device 10 so that the tapered contact surfaces 68 on the bottom sides of the nose parts 67 are substantially in flat or flush contacting relationship with the wall structure 99, which relationship positions the guide track 35 such that it slopes upwardly at a small angle, typically about 15° to about 30°, relative to the structure 99, and this additionally results in the driving head 12 of the stapler being in approximately perpendicular relationship to the wall structure 99. In this contacting position, the lower or discharge end of the guide tube 13 for the staple driver 14 is spaced upwardly from the wall structure 99, thereby defining the open driving zone or region 28 therebetween, which zone 28 extends sidewardly between the nose parts 67. The contact with the wall structure 99 also causes the safety foot 27 to be slidably displaced upwardly which, in a conventional manner, enables the internal air motor of the drive head 12 to be activated upon displacement of the trigger 25.

When in this latter position, the operator activates the device by depressing the trigger 25 whereby pressurized air supplied to the upper end of the internal air motor effects rapid downward displacement of the motor piston and of the staple driving element 14, the latter engaging the endmost staple associated with the staple row 18 and driving it downwardly along the guide 13, causing the legs of the staple to penetrate the cap 32B disposed within the driving zone 28 and thence penetrate into the wall structure 99 so as to fixedly secure the staple and the respective cap in holding contact with the wall structure 99.

Figure 8:
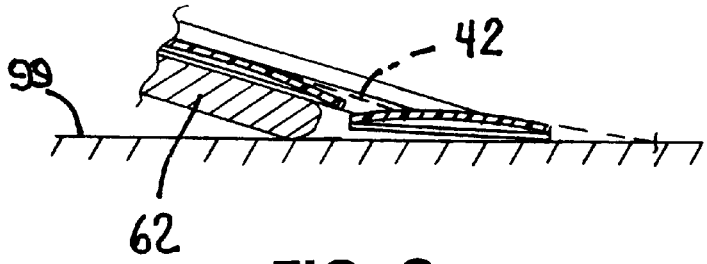
FIG. 8 is a fragmentary section view showing the positional relationship when the device is in contact with a wall structure.
Figure 9:
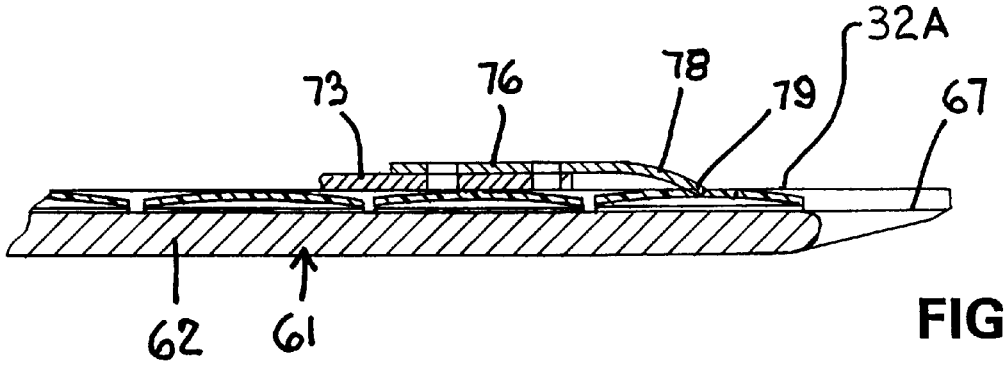
FIG. 9 is a fragmentary sectional view taken generally along line IX—IX in FIG. 5 and showing the hold-down which cooperates with the cap in the lead position.
Figure 10:
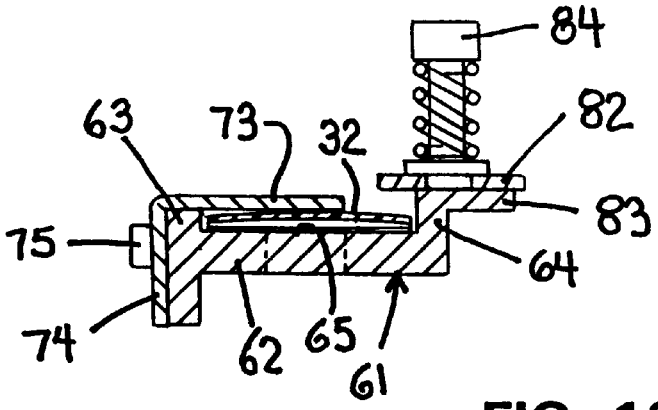
FIG. 10 is an enlarged cross-sectional view taken generally along line X—X in FIG. 5.
Figure 11:
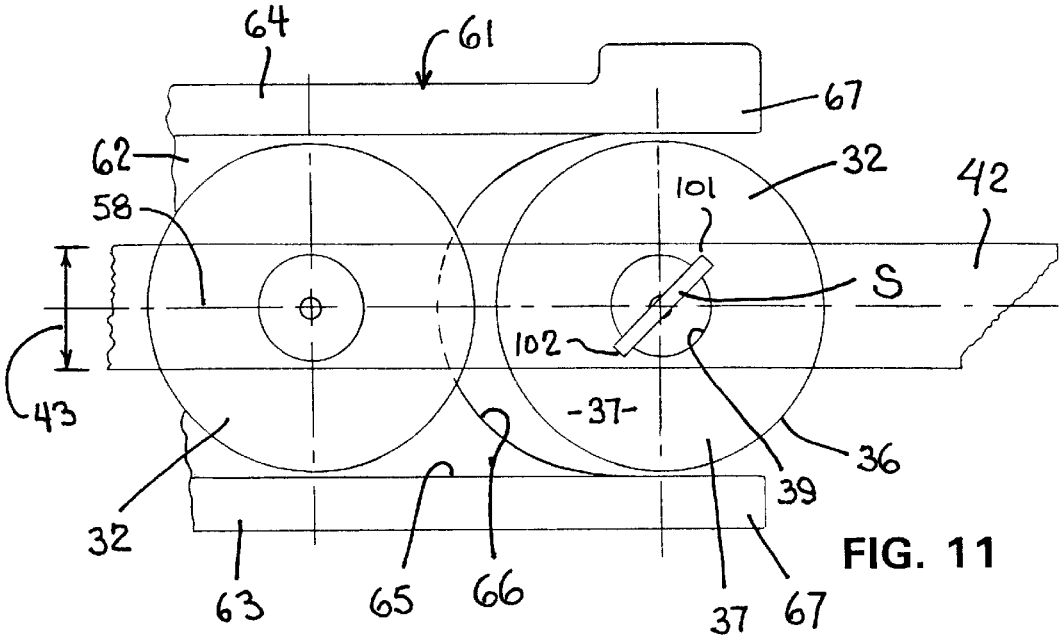
FIG. 11 is an enlarged fragmentary plan view showing the manner in which a staple penetrates the tape and cap, and the manner of tape separation.

At the time a staple is driven downwardly into and through the cap 32B within the driving zone 28, the cap within the driving zone is initially positioned so that the leading edge thereof, namely the edge which is diametrically spaced furthest from the circular edge 36 of the track, is normally contacting the surface of the wall structure 99 as illustrated in FIG. 8, whereas the other diametrical edge of the cap (i.e., the edge adjacent the lead cap) may be somewhat elevated due to the connection of the tape strip between the two adjacent caps. The downward driving of the staple and driver thus will cause the cap 32B within driving zone 28 to be angled downwardly into flat contact with the wall structure 99. This may cause tearing of the tape but, because of the small amount of cap movement, will probably only result in tensioning of the tape between the two endmost caps, and possible partial separation of the tape from the cap within the driving zone. Thus, after the staple and cap have been fixedly attached to the structure 99, the tape extending between the two endmost caps 32A and 32B may still be joined. If so, then when the user moves the device 10 away from the wall structure 99, this will effect immediate tearing of the tape 41 generally at a location along the staple. More specifically, as illustrated in FIG. 11, the fact that the legs of the staple S penetrate the tape at two locations designated 101 and 102 which are respectively positioned closely adjacent opposite sides of the tape 41, results in two narrow weak zones which extend between the tape edges and the perforated holes, which weak zones are either tensioned or possibly even torn during the stapling operation. When the operator moves the device 10 away from the wall structure, however, these weak zones are torn or ripped, if they were not previously torn, and in addition a further tear or rip occurs between the two holes generally along the staple, since the staple effectively acts as a restraining or cutting edge which permits a fairly clean and easy tearing or cutting of the tape so as to separate the staple-cap fastener as attached to the wall structure from the cantilevered tape strip 41 which extends back to the lead cap 32A.

When the user depresses the trigger 25 so as to activate the staple discharge operation due to the supplying of pressurized air to the upper chamber of the motor, the air in the lower chamber of the motor is simultaneously exhausted through the hose 96 and supplied to the air cylinder 92 which causes the piston rod 91 and advancing member 82 to be retracted from the advanced position of FIG. 7 into the retracted position of FIG. 6. During this retraction, the entire advancing mechanism can pivot upwardly about the hinge 94 due to the rear tapered cam surfaces on the projections 87, 88 camming upwardly over the caps as the advancing member 82 is retracted. The retraction stroke corresponds generally to the diameter of a single cap, so that upon reaching the retracted position illustrated in FIG. 6, the spring urges the advancing member 81 downwardly so that the driving projections 87, 88 are now disposed directly behind and engaged with the respective lead cap and next adjacent cap.

When the user moves the device 10 away from the wall structure 99 after having completed a stapling operation, this causes the safety foot 27 to move downwardly or extend, and the operator or user also will typically release the trigger 25. The downward movement of the safety foot 27 or the release of the trigger 25 is sufficient to reverse the air supply to the air motor within the tool head 12, whereby the air is again supplied to the lower chamber of the air motor so as to drive the air motor piston upwardly and at the same time the air to the drive cylinder 92 is exhausted, whereby the spring (not shown) associated with the cylinder 92 thus advances the advancing member 82 from the retracted position of FIG. 6 to the advanced position of FIG. 7. During this advancing movement, the front drive projection 87 directly engages the lead cap 32A and moves it into the drive zone 28, and simultaneously the rear projection 88 engages the next adjacent cap and advances it into the lead or feed-in position. This also exerts sufficient controlled tension on the cap string, through the adhesive tape 41, to advance the caps along the guide track 35 and to effect an incremental withdrawal of caps from the magazine.

With the overall arrangement of the device 10 as discussed above, the securement of the staple to the cap, and its positional relationship as it penetrates the cap and tape, is substantially as illustrated in FIG. 11. By having the axes or feed directions 58 and 19 of the cap strip and staple row extend at a significant angle with respect to one another, such as an angle of at least 30° and preferably about 45° as in the illustrated embodiment, the staple S extends in angled relationship relative to the tape 42 and hence the staple S has a positional relationship which results in the bridge of the staple extending at least partially in the longitudinal direction of the tape 41. This hence enables the size of the staple S (i.e., its width or crown) to be maximized in relationship to the tape width, and yet at the same time the tape width can still be maintained at a minimum relative to cap diameter so as to hence minimize the adhesive contact area between the tape and cap, thereby optimizing the interconnection of the caps while optimizing the tearing of the tape so as to permit separation of the stapled caps. With this angular relationship of at least about 45°, the staple S can hence have a width or crown which is at least approximately equal to the width of the tape, and at the same time the staple can still be positioned so that the two legs thereof both penetrate the tape so as to define two penetration holes through the tape which are disposed adjacent but inwardly spaced from the respective tape edges. This relationship, and the fact that the bridge or crown of the staple extends between these two holes and effectively acts like a cutting edge, thus permits easy and effective tearing of the tape so as to permit separation of the tape from the staple/cap attached to the wall structure without disrupting or dislocating the lead cap positioned on the device 10. The maintaining of the proper position or location of the lead cap 32A is further facilitated by the fact that the cap is not only still confined in the guide track, but the hold-down member 76 cooperates with the lead cap so as to not only exert a downward holding force thereon, but the engagement of the free end portion 79 within the top recess of the lead cap assists in preventing undesired forward or rearward movement thereof relative to the track.

In the illustrated and preferred embodiment, the staple size (i.e. crown or width) is preferably between about 35% and 50% of the cap diameter, i.e. three-eighths to one-half inch, and is of a magnitude similar to the tape width. This is believed to optimize the lateral holding power or force between the washer and the underlayment due to the bridge of the staple effecting a more effective collapsing of the dome of the plastic cap as the staple projects through the cap and penetrates into the roof structure.

It will be recognized that while the illustrated device has the guide track 35 formed in a straight line and extending at an angle of about 45° relative to the staple feeding direction, the track could be provided with a gradual curvature therein while still having the forward or discharge end thereof oriented so as to extend at the desired angular relationship with respect to the staple feeding direction. Further, under some situations the discharge end of the track may be oriented so that the angular relationship between the discharge end of the guide track and the staple feeding direction would exceed 45°, and could possibly even be as large as 90°, since in such case this would result in the staple being oriented more in the longitudinal direction of the tape, and in fact would permit use of an even larger staple, including use of a staple having a crown or bridge width greater than the tape width. As an example, the discharge end of the track could extend at an angle of about 90° relative to the staple feeding direction, and the staple could have a bridge width substantially greater than the tape width. In this example, the staple would hence be oriented so that it is penetrating the tape approximately along the longitudinal centerline thereof, with the two legs of the staple penetrating the tape and the respective cap at significant distances disposed on opposite sides of the cap centerline. With this arrangement, it is believed that the tearing of the tape would occur solely at the trailing leg puncture hole. It is believed that this arrangement would work in a highly satisfactory manner since the tear line would hence be disposed closely adjacent the trailing edge of the cap, and thus the amount of tape which would have to be adhesively released from the cap would thus be very small, and in fact this small amount of tape may be at least partially released during flattening of the cap against the wall structure during the staple driving phase, and hence would still result in ease of tearing of the tape and hence ease of separation of the stapled cap from the remaining cap strip.

The overall internal structure and operation of the automatic stapler 11 is conventional, as previously indicated, and further detailed description thereof is accordingly believed unnecessary.

While the device 10 of the present invention is disclosed as having particular suitability for use in securing underlayments to a roof substrate, it will be appreciated that this device will also find other uses particularly in the construction industry, such as for permitting attachment of thin, flexible and/or deformable materials to other wall structures.

Although the description presented above describes the use of plastic caps joined by an adhesive tape strip, it will be appreciated that thin caps of other materials capable of penetration by a staple, such as thin metal caps, is also within the scope of the present invention. Further, while use of cap strips using an adhesive tape for joining adjacent caps is a desired and preferred construction for use with the device of the present invention, it will likewise be appreciated that other means of joining the caps into a strip can also be provided, some examples of which are described in detail in aforementioned WO 99/39878.

While the present invention has been illustrated and described as employing fixed nose parts 67 which are positioned at the discharge end of the track and are disposed on opposite sides of the stapling position, nevertheless it will be appreciated that the device of the present invention can replace the fixed nose parts 67 with a movable nose part (i.e. a foot) which would at least partially surround the cap which is fed into the stapling position, with this moving foot being connected to and movable with the lower end of the movable safety element 26. This latter construction is illustrated in aforementioned WO99/39878, owned by the Assignee hereof.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A cap feeding device for an automatic powered fastener driver having a magazine which contains a plurality of fasteners and which supplies a fastener to a driving zone for driving engagement with a fastener driving member which is movably supported on a driving head for engaging and forwardly driving the fastener out of the driving zone into a building structure such as a roof, said cap feeding device comprising:

a housing defining therein a storage space for a plurality of thin disk-like caps which are connected together in sidewardly adjacent edge-to-edge relationship so as to define an elongate flexible cap strip, the strip having portions which are disposed in generally superimposed relationship for compact storage within the storage space of the housing, the housing defining therein a discharge passage for permitting a leading end of the cap strip to be discharged therethrough;

an elongate guideway extending from said discharge passage and terminating in a remote end disposed generally at said driving zone for slidably guiding the leading end of the cap strip from the discharge passage to the driving zone;

said guideway defining an elongate support surface which extends from said discharge passage and which terminates at a remote free end which is disposed directly sidewardly adjacent said driving zone, said support surface slidably supporting the leading end of said cap strip thereon so that the leading cap of said strip is positionable at a lead-in position defined at the free end of said support surface in laterally spaced but generally sidewardly aligned relation with said driving zone;

a cap driving arrangement including a driving member which directly drivingly engages the leading cap as disposed in said lead-in position for advancing the leading cap from the lead-in position into the driving zone; and a resilient hold-down member engaged with an upper surface of the cap disposed in said lead-in position for preventing rearward movement thereof along the guideway.

2. A device according to claim 1, wherein the guideway has a pair of stop members which are fixed to and project outwardly in parallel relationship from the front free edge thereof in straddling relationship to the driving zone for sidewardly guiding the cap which is advanced from the lead-in position into the driving zone, said sidewardly spaced stops having lower surfaces thereon which are adapted to directly abuttingly contact the wall structure so that the fastener is driven through the cap into the wall structure during a fastener driving operation.

3. A device according to claim 1, wherein the cap has a recess formed in and opening downwardly from the upper surface thereof, and said resilient hold-down member projecting into the recess of the cap disposed at said lead-in position for preventing forward or rearward displacement of said cap except when the cap is advanced into the driving zone by the driving member.

4. A device according to claim 3, wherein the hold-down member comprises an elongate cantilevered spring member having a free end thereof resiliently urged into a position wherein it projects into the recess of the cap at the lead-in position.

5. A device according to claim 1, wherein said guideway defines a shallow upwardly opening channel having an inner bottom surface which defines said support surface and having side walls which join to said bottom wall and project upwardly therefrom, the sideward spacing between said side walls being such as to closely confine the caps therebetween as the leading end of the cap strip slidably moves from the discharge passage to the lead-in position, and said side walls having wall parts which are cantilevered forwardly beyond the leading edge of said bottom wall so as to sidewardly straddle said driving zone and the cap which is advanced forwardly from the lead-in position into the driving zone.

6. The device according to claim 5, wherein the wall parts which straddle the driving zone have bottom surfaces which extend in angled relationship relative to the elongate direction of the guideway and which supportingly engage an exposed surface of the wall structure into which the fastener is to be driven so as to permit the cap disposed within the driving zone to at least partially engage the surface of the wall structure prior to the fastener being driven through the cap.

7. A device according to claim 1, wherein the fastener comprises a staple having two legs which project through the cap, the staple having a maximum width which is about 50% of the cap diameter.

8. The device according to claim 1, wherein the caps are connected together in edge-to-edge relationship by an elongate flexible tape which is adhesively connected to the individual caps so as to define the elongate flexible cap strip, said adhesive tape having a width which is significantly less than the diameter of the caps.

9. A driving feeding device for a staple, comprising:

a staple driving unit including a driving head having a staple guide member fixed to one end thereof and terminating in a discharge end, and a staple driver slidably supported along the guide member for ejecting a staple along a first axis which extends lengthwise of the guide member;

a staple cartridge mounted to said driving unit for supporting a stack of channel-like staples so that an endmost staple of the stack is positioned for engagement with the staple driver during driving movement thereof;

a cap feeding device coupled to said driving unit for intermittently and sequentially feeding a thin disk-like cap into a driving position disposed adjacent and substantially aligned with the discharge end o the guide member, said cap feeding device including:

(a) a magazine for containing an elongate cap strip defined by a plurality of thin disk-like caps disposed in closely adjacent edge-to-edge positional relationship and serially connected by a connecting member, (b) the caps having a shallow dome-shaped configuration when viewed in cross-section and constructed of a plastic material so as to be resiliently deformable when a staple is driven therethrough, (c) a track arrangement extending from a discharge of said magazine to said driving region for movably supporting thereon a length of said cap strip so that a leading cap of said length is disposed in a lead-in position which is sidewardly spaced from said driving position, (d) a cap advancing device for advancing a cap from said lead-in position to said driving position wherein it is penetrated by the staple discharged along said first axis by said staple driver; and said staples as provided in the staple cartridge having a crown width of about 35% to about 50% of the cap diameter.

10. A device according to claim 9, wherein the connecting member joining the caps together to define the elongate cap strip comprises an elongate flat adhesive tape which extends continuously along the cap strip and is adhesively joined to each cap along said strip, said tape having a width which is significantly smaller than the diameter of the caps.

11. A device according to claim 10, wherein the staple which penetrates the cap also penetrates the tape to assist in effecting transverse separation of the tape.

12. A device according to claim 11, wherein the staple which penetrates the cap extends in angled relationship relative to both the longitudinal and transverse directions of the elongate flat adhesive tape and is sized so that both legs of the staple penetrate both the cap and the tape.

13. A driving feeding device for a staple/cap fastener comprising:

a staple driving unit including a driving head having a staple guide member fixed to one end thereof and terminating in a discharge end, and a staple driver slidably supported within the guide member for ejecting a staple along a first axis which extends lengthwise of the guide member;

an elongate staple cartridge fixed to said driving head and projecting transversely therefrom, said cartridge defining therein a support rail which extends along a second axis in generally transverse and intersecting relation to said first axis, said rail being adapted to support a stack of channel-like staples thereon so that an endmost staple of the stack is positioned for engagement with the staple driver during extending driving movement thereof;

a cap feeding device fixedly coupled to said staple driving unit for intermittently and sequentially feeding a thin disk-like cap into a driving position disposed closely adjacent and substantially aligned with the discharge end of the guide member, said cap feeding device including:

(a) a magazine for containing an elongate cap strip defined by a plurality of thin disk-like caps disposed in closely adjacent edge-to-edge positional relationship and serially connected by a connecting member, (b) a track arrangement extending from a discharge of said magazine to said driving position, said track arrangement being adapted to movably support thereon a length of said cap strip so that a leading cap of said length is disposed in a lead-in position which is substantially adjacent but sidewardly spaced from said driving position, said track arrangement including a guide track having a discharge end which defines said lead-in position, and said track arrangement guiding movement of the cap from the lead-in position to the driving position along a third axis which substantially transversely intersects said first axis, (c) a cap advancing device cooperating with at least one of the caps on said guide track and being intermittently movable between advanced and retracted positions for advancing a cap from said lead-in position to said driving position wherein it is aligned with and penetrated by the staple discharged along said first axis by said staple driver, (d) a resilient hold-down device positioned adjacent the discharge end of said guide track and cooperatively engaged with the cap disposed at said lead-in position for preventing significant backward displacement of said cap along the guide track; and a handle fixedly interconnected to said drive head for permitting manual manipulation of the device.

14. A driving feeding device for a staple/cap fastener, comprising:

a staple driving unit including a driving head having a staple guide member fixed to one end thereof and terminating in a discharge end, and a staple driver slidably supported within the guide member for ejecting a staple along a first axis which extends lengthwise of the guide member;

an elongate staple cartridge fixed to said driving head and projecting transversely therefrom, said cartridge defining therein a support rail which extends along a second axis in generally transverse and intersecting relation to said first axis, said rail being adapted to support a stack of channel-like staples thereon so that an endmost staple of the stack is positioned for engagement with the staple driver during extending driving movement thereof;

a cap feeding device fixedly coupled to said staple driving unit for intermittently and sequentially feeding a thin disk-like cap into a driving position disposed closely adjacent and substantially aligned with the discharge end of the guide member, said cap feeding device including:

(a) a magazine for containing an elongate cap strip defined by a plurality of thin disk-like caps disposed in closely adjacent edge-to-edge positional relationship and serially connected by a connecting member, (b) a track arrangement extending from a discharge of said magazine to said driving position, said track arrangement being adapted to movably support thereon a length of said cap strip so that a leading cap of said length is disposed in a lead-in position which is substantially adjacent but sidewardly spaced from said driving position, said track arrangement including a guide track having a discharge end which defines said lead-in position, and said track arrangement guiding movement of the cap from the lead-in position to a driving position defined within said driving region along a third axis which substantially transversely intersects said first axis, said third axis when viewed in a plane perpendicular to said first axis extending at an angle of at least about 30° relative to said second axis, (c) a cap advancing device cooperating with at least one of the caps on said guide track and being intermittently movable between advanced and retracted positions for advancing a cap from said lead-in position to said driving position wherein it is aligned with and penetrated by the staple discharged along said first axis by said staple driver; and a handle fixedly interconnected to said drive head for permitting manual manipulation of the device.

15. A device according to claim 14, wherein said third axis, when viewed in a plane perpendicular to said first axis, extends at an angle of about 45° relative to said second axis.

16. A driving feeding device for a staple/cap fastener comprising:

a staple driving unit including a driving head having a staple guide member fixed to one end thereof and terminating in a discharge end, and a staple driver slidably supported within the guide member for ejecting a staple along a first axis which extends lengthwise of the guide member;

an elongate staple cartridge fixed to said driving head and projecting transversely therefrom, said cartridge defining therein a support rail which extends along a second axis in generally transverse and intersecting relation to said first axis, said rail being adapted to support a stack of channel-like staples thereon so that an endmost staple of the stack is positioned for engagement with the staple driver during extending driving movement thereof;

a cap feeding device fixedly coupled to said staple driving unit for intermittently and sequentially feeding a thin disk-like cap into a driving position disposed closely adjacent and substantially aligned with the discharge end of the guide member, said cap feeding device including:

(a) a magazine for containing an elongate cap strip defined by a plurality of thin disk-like caps disposed in closely adjacent edge-to-edge positional relationship and serially connected by a connecting member, (b) a track arrangement extending from a discharge of said magazine to said driving position, said track arrangement being adapted to movably support thereon a length of said cap strip so that a leading cap of said length is disposed in a lead-in position which is substantially adjacent but sidewardly spaced from said driving position, said track arrangement including a guide track having a discharge end which defines said lead-in position, and said track arrangement guiding movement of the cap from the lead-in position to a driving position defined within said driving region along a third axis which substantially transversely intersects said first axis, (c) said track arrangement including a pair of stop members cantilevered forwardly from said lead-in position and disposed on opposite sides of said driving position with the latter opening vertically between the sidewardly spaced stop members, said stop members on lower surfaces thereof defining sloped contact surfaces adapted to be positioned in abutting engagement with a wall surface so as to position the track arrangement in an inclined relationship relative to the wall surface when the device is being used to discharge a staple into the wall structure, (d) a cap advancing device cooperating with at least one of the caps on said guide track and being intermittently movable between advanced and retracted positions for advancing a cap from said lead-in position to said driving position wherein it is aligned with and penetrated by the staple discharged along said first axis by said staple driver; and a handle fixedly interconnected to said drive head for permitting manual manipulation of the device.

17. A device according to claim 16, wherein the cap positioned in the driving position remains connected to the cap in the lead-in position prior to discharge of the staple, and the cap in the driving position having at least a leading edge portion thereof disposed in contact with the wall surface when the sloped contact surfaces on the stop members are engaged with the wall surface.

18. A driving feeding device for a staple/cap fastener, comprising:

a staple driving unit including a driving head having a staple guide member fixed to one end thereof and terminating in a discharge end, and a staple driver slidably supported within the guide member for ejecting a staple along a first axis which extends lengthwise of the guide member;

an elongate staple cartridge fixed to said driving head and projecting transversely therefrom, said cartridge defining therein a support rail which extends along a second axis in generally transverse and intersecting relation to said first axis, said rail being adapted to support a stack of channel-like staples thereon so that an endmost staple of the stack is positioned for engagement with the staple driver during extending driving movement thereof;

a cap feeding device fixedly coupled to said staple driving unit for intermittently and sequentially feeding a thin disk-like cap into a driving position disposed closely adjacent and substantially aligned with the discharge end of the guide member, said cap feeding device including:

(a) a magazine for containing an elongate cap strip defined by a plurality of thin disk-like caps disposed in closely adjacent edge-to-edge positional relationship and serially connected by a connecting member, (b) a track arrangement extending from a discharge of said magazine to said driving position, said track arrangement being adapted to movably support thereon a length of said cap strip so that a leading cap of said length is disposed in a lead-in position which is substantially adjacent but sidewardly spaced from said driving position, said track arrangement including a guide track having a discharge end which defines said lead-in position, and said track arrangement guiding movement of the cap from the lead-in position to a driving position defined within said driving region along a third axis which substantially transversely intersects said first axis, (c) a cap advancing device cooperating with at least one of the caps on said guide track and being intermittently movable between advanced and retracted positions for advancing a cap from said lead-in position to said driving position wherein it is aligned with and penetrated by the staple discharged along said first axis by said staple driver, the cap advancing device including a driving projection which when in the retracted position directly abuttingly engages a rear edge of the cap in the lead-in position for effecting direct advancing thereof into the driving position; and a handle fixedly interconnected to said drive head for permitting manual manipulation of the device.

19. A portable driving feeding device for a staple/cap fastener adapted for securement to a wall structure, said device comprising:

a staple driving unit including a driving head and a staple driver slidably supported for movement relative to the driving head along a first direction for ejecting a staple along said first direction from a discharge end of said driving head;

a staple cartridge stationarily mounted to said driving unit for supporting a stack of channel-like staples so that the endmost staple of the stack is positioned for engagement with a staple driver during driving movement thereof, said stack of staples being movably supported for advancing movement along a second direction which substantially transversely intersects said first direction so that the endmost staple of the stack is positioned for engagement by the staple driver;

a cap feeding device coupled to the staple driving unit for intermittently and sequentially feeding a thin disk-like cap into a driving position which is defined along said first direction and is disposed adjacent and substantially aligned with the discharge end of said driving head;

said cap feeding device including a magazine containing an elongate cap strip defined by a plurality of thin disk-like caps disposed in closely adjacent edge-to-edge positional relationship and serially connected by an elongate flat adhesive tape which extends continuously along the cap strip and is adhesively joined to an upper surface of each cap along said strip;

said cap feeding device further including a track arrangement extending from a discharge of said magazine to said driving region for movably supporting thereon a length of said cap strip so that an endmost cap of said length is disposed in said driving position and the next adjacent cap of said length is disposed in a lead-in position which is sidewardly adjacent said driving position, said cap strip being oriented such that the adhesive tape secured to said caps faces toward the discharge end of the staple driving head;

said cap feeding device also including a cap advancing device for advancing a cap from said lead-in position to said driving position wherein it is penetrated by the staple discharged along said first direction by said staple driver;

a stop structure disposed adjacent the discharge end of said track arrangement and having stop surfaces adapted for positional contact with a wall structure, said stop structure defining sidewardly spaced guide members for sidewardly positioning the cap when disposed in said driving position; and said staple having a crown width which is less than the width of the cap and which is positioned so that both legs of the staple penetrate the cap and the crown of the staple extends transversely relative to the adhesive tape so that the staple crown effectively functions as a cutting edge to facilitate transverse tearing of the tape when the cap in the driving position is separated from the strip.

20. A device according to claim 19, wherein said adhesive tape has a width which is substantially less than the width of the caps to minimize adhesive contact area between the tape and the caps, and at least one of the legs of the staple penetrating the tape during driving of the staple through the cap so as to facilitate transverse tearing of the tape.

21. A device according to claim 19, wherein the staple as it penetrates the cap is oriented such that the crown of the staple extends at an acute angle relative to both the longitudinal and transverse dimensions of the tape, and the length of the staple crown is such that both legs of the staple penetrate the tape and the cap.

22. A driving feeding device for a staple/cap fastener, comprising:

a staple driving unit including a driving head having a staple guide member fixed to one end thereof and terminating in a discharge end, and a staple driver slidably supported along the guide member for ejecting a staple along a first path which extends lengthwise of the guide member;

a staple cartridge mounted to said driving unit for supporting a stack of channel-like staples so that an endmost staple of the stack is positioned for engagement with the staple driver during driving movement thereof;

a cap feeding device coupled to said driving unit for intermittently and sequentially feeding a thin disk-like cap into a driving position disposed adjacent and substantially aligned with the discharge end of the guide member, said cap feeding device including:

(a) a magazine for containing an elongate cap strip defined by a plurality of thin disk-like caps disposed in closely adjacent edge-to-edge positional relationship and serially connected by a connecting member, (b) a track arrangement extending from a discharge of said magazine to said driving region for movably supporting thereon a length of said cap strip so that a leading cap of said length is disposed in a lead-in position which is sidewardly spaced from said driving position, and (c) a cap advancing device for advancing a cap from said lead-in position to said driving position wherein it is penetrated by the staple discharged along said first axis by said staple driver; and said caps being formed as thin circular disk-like members constructed of a plastic material, said staples having a crown width which is less than the diameter of the cap, and said discharged staple being positioned so as that both legs thereof are driven through the cap disposed in said driving position.

23. The device according to claim 22, wherein the cap has a shallow dome-shaped configuration which is resiliently deformed when the staple is driven through the cap.

* * * * *

UNITED STATES PATENT AND TRADEMARK OFFICE

CERTIFICATE OF CORRECTION

PATENT NO. : 6,478,209 B1
DATED : November 12, 2002
INVENTOR(S) : Roger C. Bruins et al.

It is certified that error appears in the above-identified patent and that said Letters Patent is hereby corrected as shown below:

Column 16,
Line 33, change “end o the” to -- end of the --.

Signed and Sealed this

Tenth Day of June, 2003

JAMES E. ROGAN
*Director of the United States Patent and Trademark Office*